United States Patent [19]

Bukatarevic

[11] 4,004,555

[45] Jan. 25, 1977

[54] ROTARY PISTON INTERNAL COMBUSTION ENGINE HAVING A HEAT TRANSFER PHASE

[76] Inventor: Dragan Bukatarević, 75, Lionel Road, Brentford, Middlesex, England

[22] Filed: Mar. 17, 1975

[21] Appl. No.: 558,739

[30] Foreign Application Priority Data

Apr. 1, 1974 Yugoslavia ..... 898/74

[52] U.S. Cl. ..... 123/8.05; 123/8.47; 418/36

[51] Int. Cl.[2] ..... F02B 53/00

[58] Field of Search ..... 23/8.47, 8.05; 418/36

[56] References Cited

FOREIGN PATENTS OR APPLICATIONS

| | | | |
|---|---|---|---|
| 26,581 | 8/1920 | Denmark | 123/8.47 |
| 1,187,052 | 4/1970 | United Kingdom | 123/8.45 |

*Primary Examiner*—Carlton R. Croyle
*Assistant Examiner*—Michael Koczo, Jr.
*Attorney, Agent, or Firm*—Larson, Taylor and Hinds

[57] ABSTRACT

The invention concerns an internal combustion engine having an annular cylinder and two co-axial rotors each carrying three or more equi-spaced pistons disposed in the cylinder, the rotors being constrained to undergo cyclic counterphased variations in speed such that the pistons of the two rotors alternately approach and recede from each other and the expansion, exhaust, induction and compression phases of a combustion cycle can be carried out between the pistons making use of inlet exhaust and ignition means provided, there being provision for charge-transfer phase(s) in the combustion cycle between induction of a charge and its compression, each charge transfer past a given piston being effected through a transfer port by a following piston and the number of charge transfer phases in each combustion cycle being equal to the number by which the number of pistons on each rotor exceeds two.

6 Claims, 25 Drawing Figures

ROTARY PISTON INTERNAL COMBUSTION ENGINE HAVING A HEAT TRANSFER PHASE

The invention relates to a rotary internal combustion engine.

When converting thermal energy into mechanical work or into electrical energy, there are several limitations which prevent the attainment of a high degree of efficiency. On the one hand, the thermodynamic process itself is limited both in its scope and its variety, and on the other hand considerable losses are caused by heat loss, mechanical friction and imperfect combustion of fuel.

These problems are sought to be solved or at least mitigated by this invention by the provision of an engine construction ddescribed below.

The invention provides a rotary internal combustion engine having annular cylinder and two co-axial rotors each carrying three or more equi-spaced pistons disposed within and projecting towards the cylinder, the rotors being constrained to undergo as they rotate cyclic counterphased and substantially sinusoidal variations in speed such that the pistons of the two rotors alternately approach and recede from one another and the expansion, exhaust, induction and compression phases of the working cycle are carried out between the pistons making use of gas inlet, exhaust and ignition means provided, characterised in that there is provision for at least one phase in the working cycle between induction of a charge and its compression for transfering energy from the exhaust gases to the combustible mixture of fuel and gas at a constant volume of the latter, said at least one phase, in relation to a given piston being effected through a transfer port by a following piston as the given piston is moving slowly in the course of its speed variation, and the number of charge transfer phases in each combustion cycle being equal to the number by which the number of pistons on each rotor exceeds two.

The engine may be provided with one or more exhaust-heat exchangers through which the transferred charge passes.

A suitable construction is one in which to provide the rotor constraint a mainshaft coaxial with the rotors carries an eccentrically mounted, common mainshaft gear or pair of such gears, the mainshaft gear(s) meshing with intermediate gears on respective intermediate shafts which gears themselves mesh with respective rotor-control gears on rotor-control shafts driven by the rotors, the speed relation between rotors and mainshaft being $x : 1$ where $x$ is the number of pistons on each rotor, and each intermediate shaft, while free bodily to approach and recede from the axis of the mainshaft as is rotates, being maintained at a constant axial spacing from the or its respective mainshaft gear on the one hand and the respective rotor control shaft on the other hand.

In different embodiments there are provided engines:

a. having a common mainshaft gear, in which engine the rotors carry externally toothed gears driving respective pinions carried on the rotor-control shaft, which are diametrically oppositely disposed with respect to the mainshaft, b. having a pair of mainshaft gears, in which engine the rotors carry externally toothed gears at axially opposite ends of the cylinder, driving respective pinions carried on the rotor control shafts, c. having a pair of mainshaft gears, in which engine the rotors are hollow and carry internally toothed gears driving respective pinions on rotor control shafts which are disposed in the space within the hollow rotors.

With the engines described it is possible to accomplish an internal, i.e. thermodynamic, cooling of the pistons in the course of of which loss of cooling energy is minimized and the energy is used without increasing friction substantially, which is the case with "classical" piston engines. Apart from this, the system makes it possible to utilize part of the energy produced by the exhaust gases thereby making for greater efficiency; from a theoretical point of view this efficiency is very high and it certainly is considerably greater than the efficiency of the Otto-cycle. The invention substantially assures improved combustion owing to higher temperatures present in the process of fuel vaporisation and it reduces noise considerably because energy is being taken out of the exhaust gases.

The rotors are coupled through a system of gears and a geared main shaft, which is also the rotor control mechanism so that there appears, apart from the angular motion, an intermittent oscillating motion, whose deviation from a sinusoidal motion is less than 1%. The sinusoidal motions of the rotors are counterphasic so that the pistons approach each other at one moment, thereby reducing the space, and then they recede from each other thereby increasing the space, and all this makes it possible for the thermodynamic process to be carried out in correspondence with a four-cylinder four-stroke piston engine, regardless of the number of vanes on the rotor. The number of vanes is at the same time the ratio between the number of revolutions of the main shaft in the rotor control mechanism and the mean number of revolutions of the two rotors. The total number of pistons corresponds to the number of the thermodynamic stages of the working cycle, which occur in partially overlapping segments of the stator. Four stator segments are used for the four stages of the working cycle — i.e. induction, compression, expansion and exhaust, and the remaining segments are used for the cooling of pistons and for the transfer of energy contained in the exhaust gases.

When a rotor is oscillating its inertia contains (apart from the characteristic oscillations at double the natural frequency and removed from the system with the help of a flywheel or with the help of another system which is one-fourth of a cycle behind the first one) oscillations at the natural frequency which is not removed from the system and which is maintaining the basic phase. There are practically no linear oscillations, which are characteristic of piston engines.

The effects of the working fluid on the cylinder are such that the cylinder need not be of massive and solid construction and these effects are mainly concentrated on the pistons, where they act in opposite directions, their action being of varying intensity and sense. The difference between the actions, which is positive if one takes the cycle as a whole, appears as a product of the system on the main shaft in a shape characteristic for a four cylinder, four-stroke piston engine with very long connecting rods. Acting in this way the system contains a passive force arising from the differences in its actions and this force increases the mechanical losses in the gears, but these losses do not exceed the values of losses occuring with piston engines and it can be proved that they are equal to twice the value of losses in the gears on starting, and considerably less during operation. These losses are not dependent on the size of the system.

Preferred embodiments of the invention are explained by way of example only in the following description with reference to the accompanying drawings. In the drawings.

Figure 1:
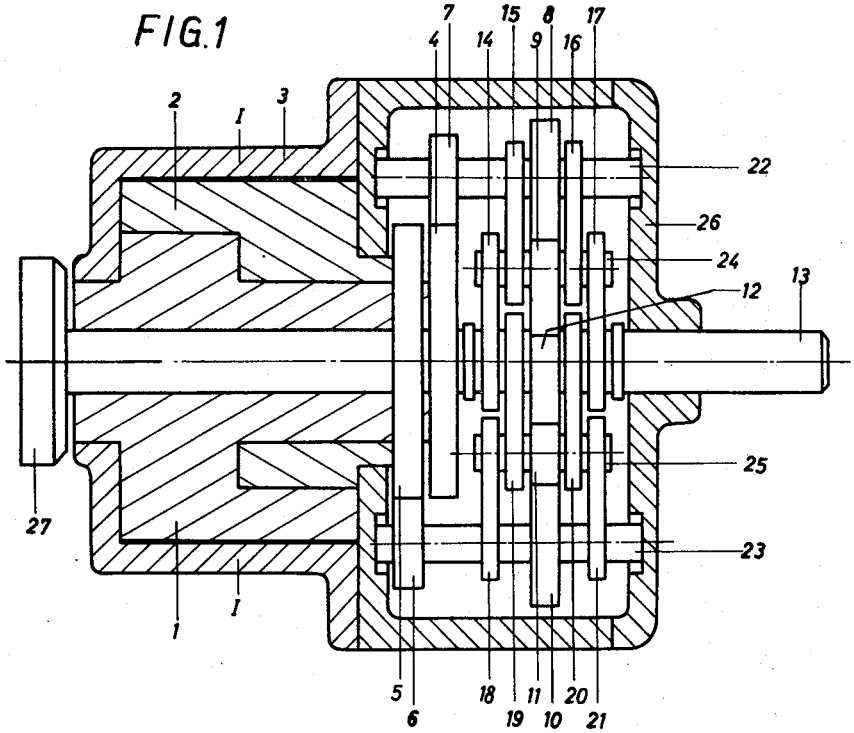
FIG. 1 represents a part-sectional elevation of a rotary internal combustion engine embodying the invention and with two rotors each carrying three pairs of pistons, viewed from the side.
Figure 2:
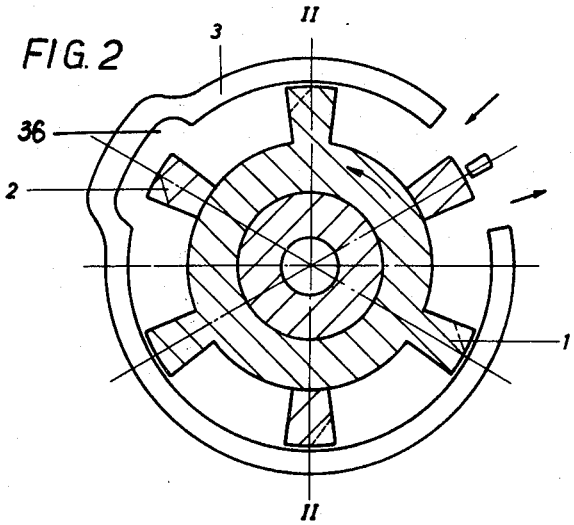
FIG. 2 represents a section I — I from FIG. 1.
Figure 3:
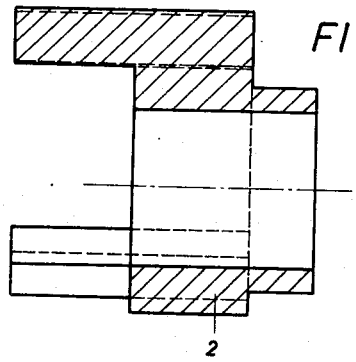
FIG. 3 shows a rotor with its pistons as contained in the engine of FIG. 1.
Figure 4:
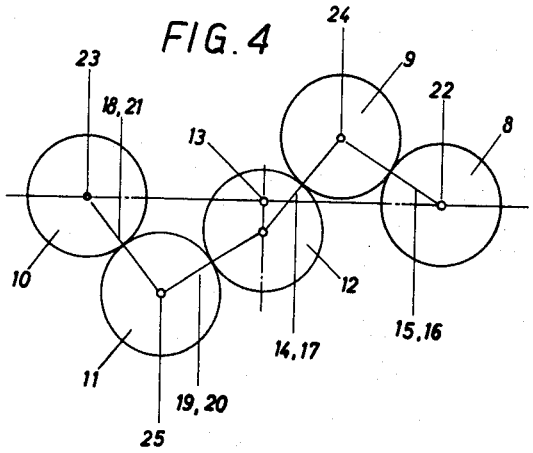
Figure 5:
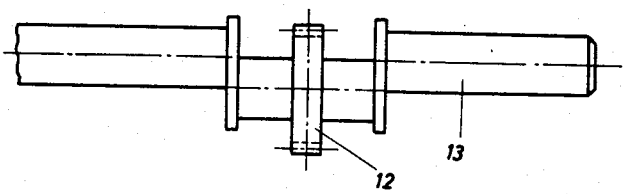
Figure 6:
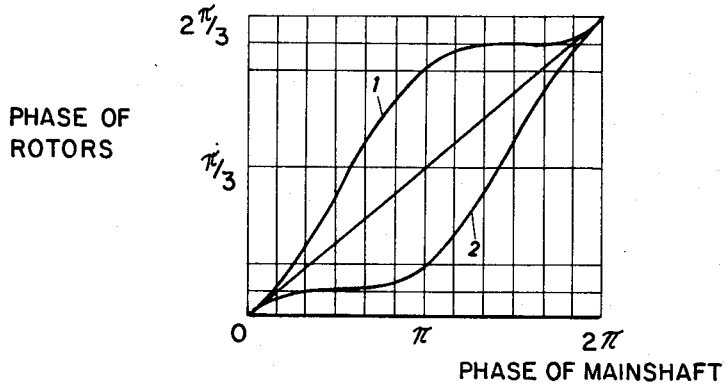

FIG. 4 gives a simplified outline of the engine's rotor control mechanism as viewed axially of the engine;

FIG. 5 is a detail from FIG. 1 and represents a mainshaft;

FIG. 6 displays phase changes of the rotors from 0 through $\pi 3$ (mid-point) to $2\pi/3$, along the ordinate, and of the mainshaft from 0 to $2\pi$, for the engine according to FIG. 1.

Figure 7:
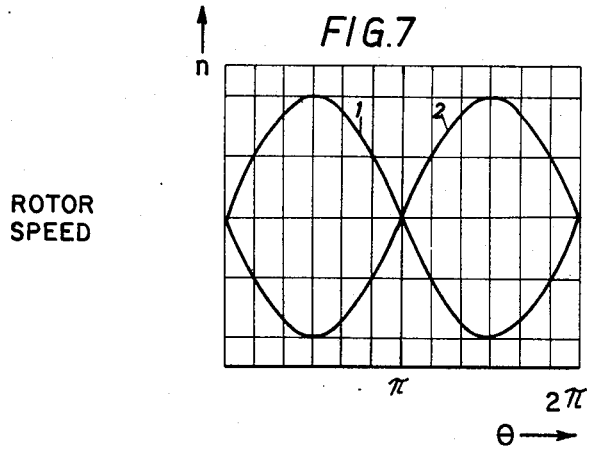
Figure 8:
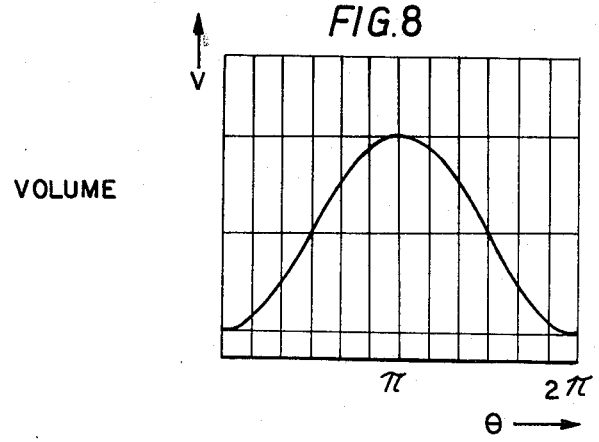
Figure 9A:
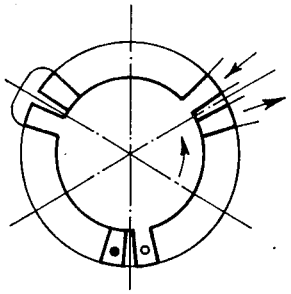
Figure 9B:
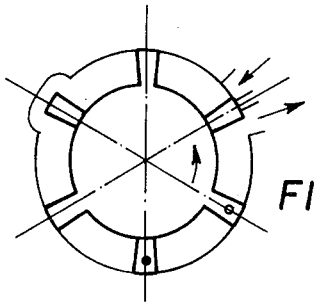
Figure 9C:
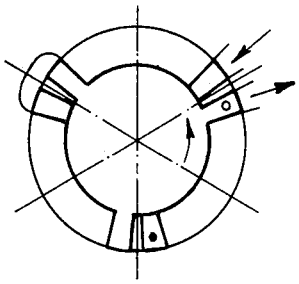
Figure 9D:
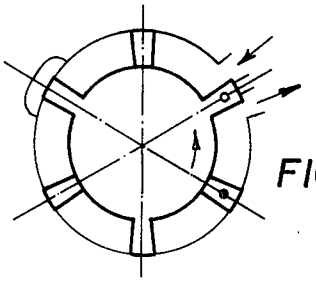
Figure 10:
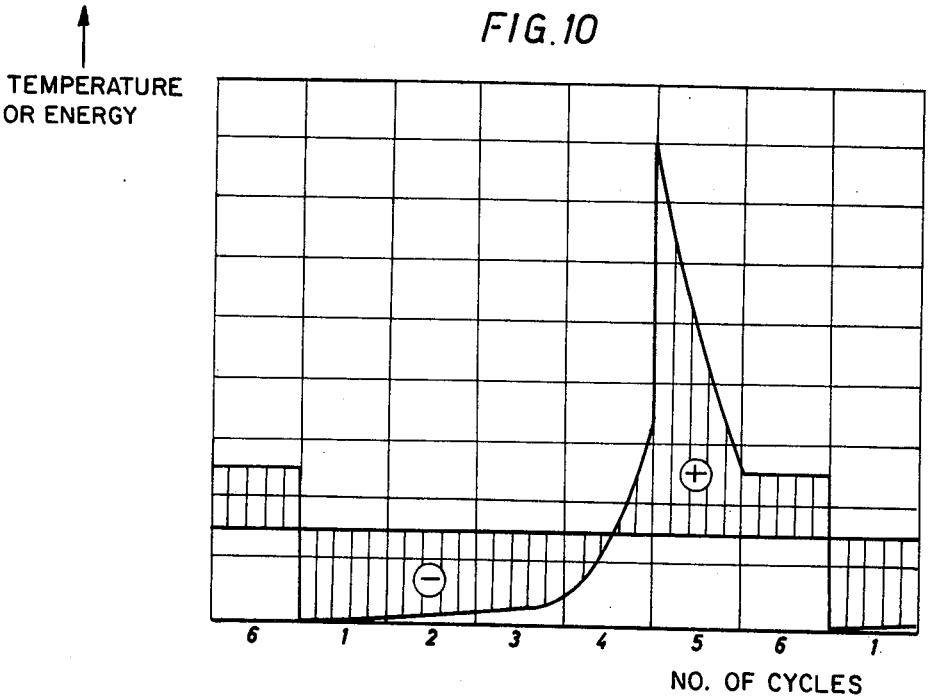
Figure 11:
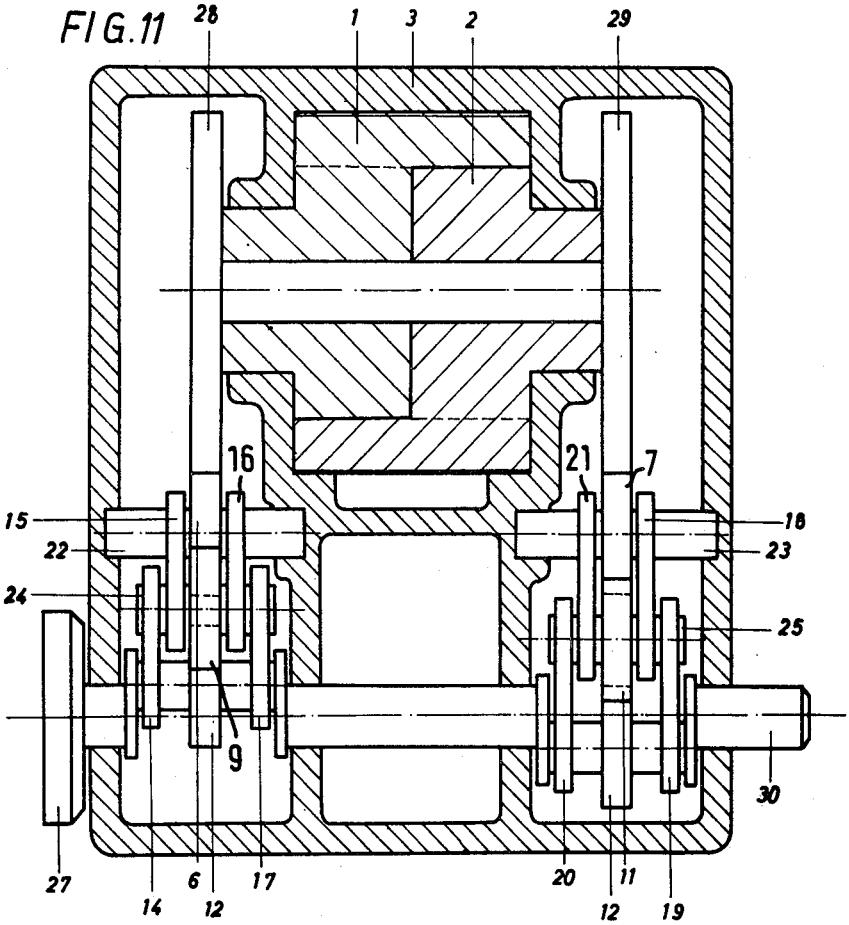
Figure 12:
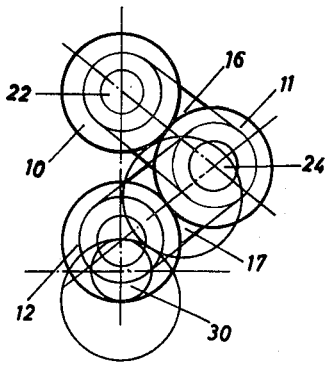
Figure 13:
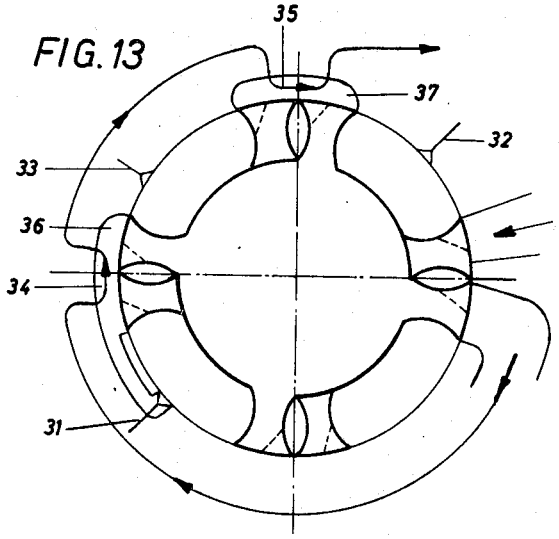
Figure 14:
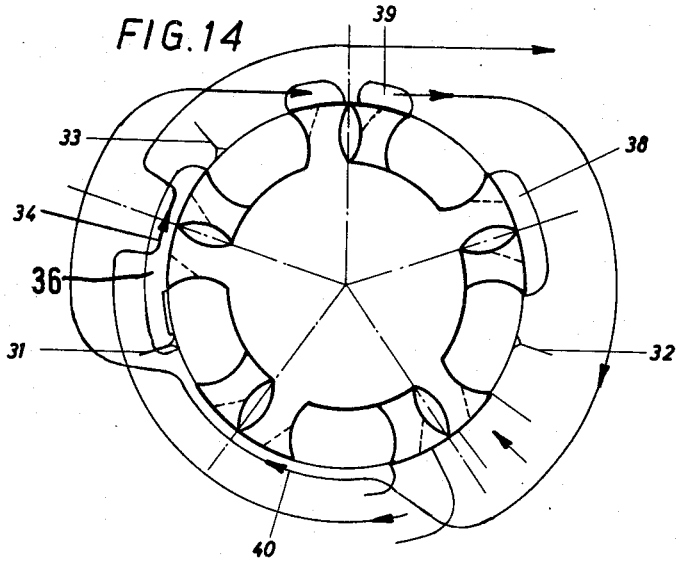
Figure 15:
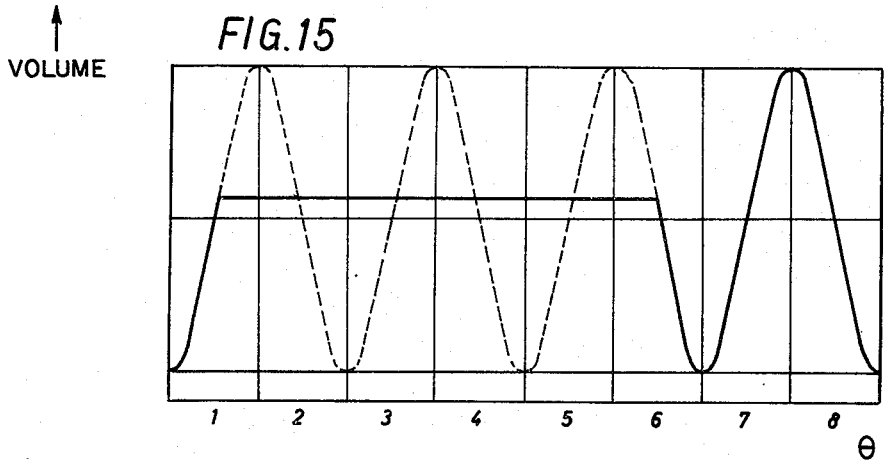
Figure 16:
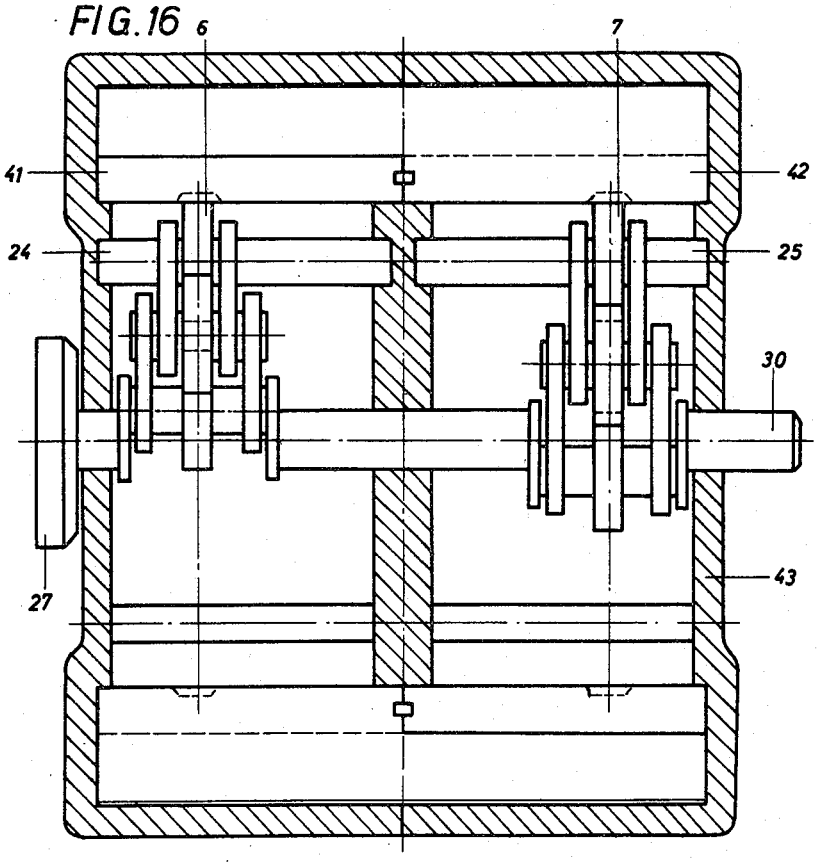
Figure 17:
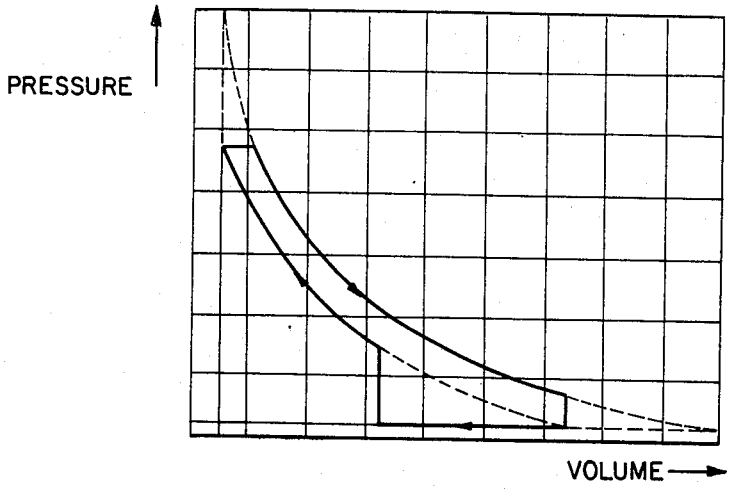
Figure 18:
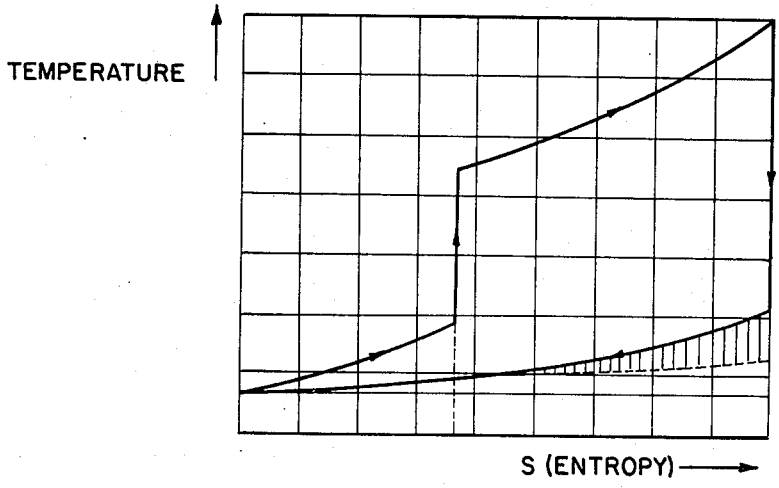
Figure 19:
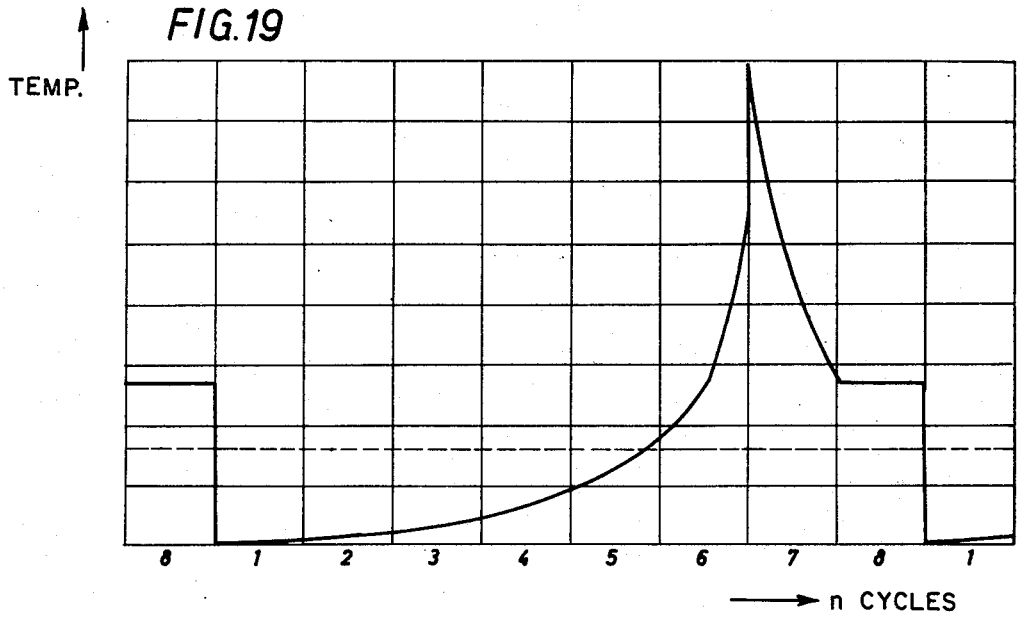
Figure 20:
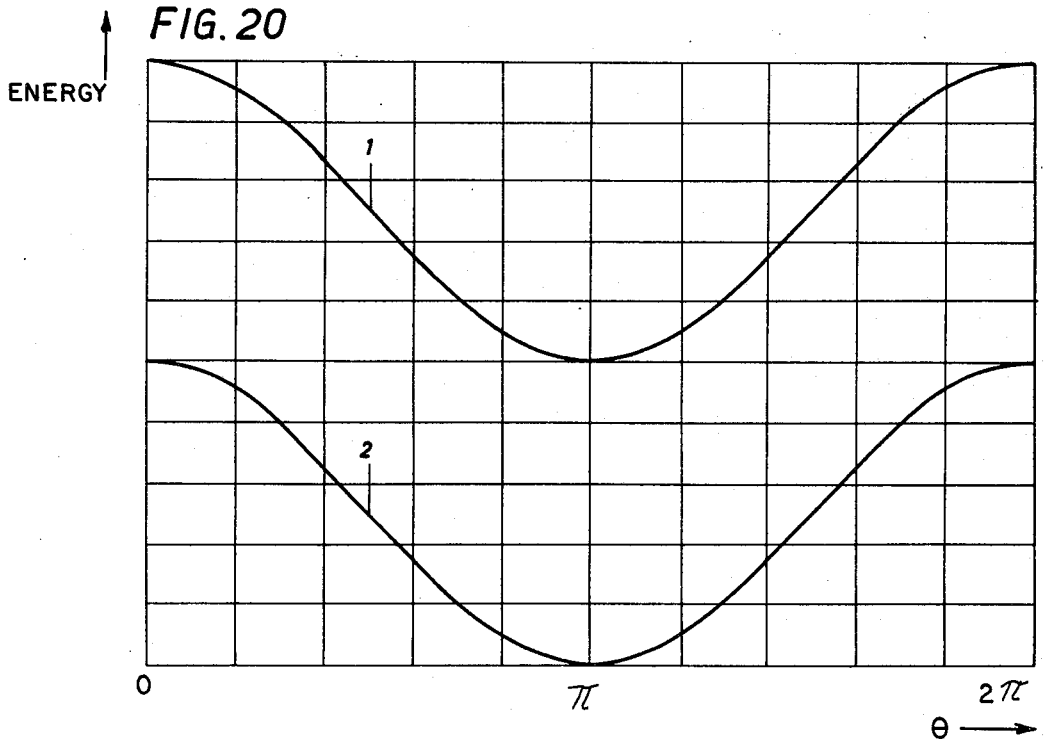
Figure 21:
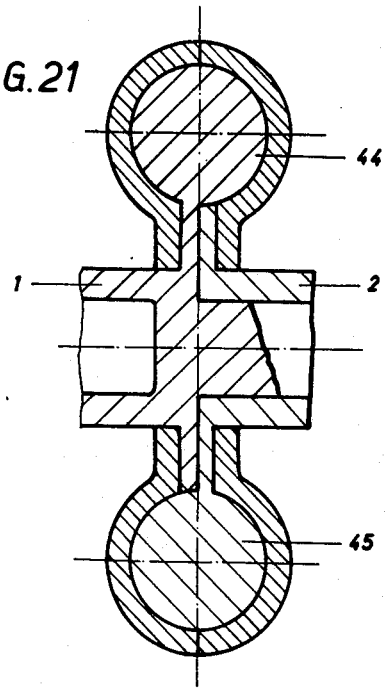
Figure 22:
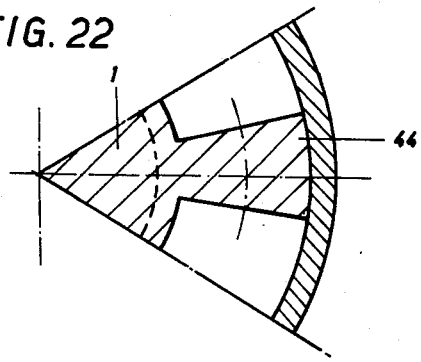

FIG. 7 traces changes of rotor speed (ordinate) with changes in the angular displacement of the mainshaft;

FIG. 8 traces volume changes between a given pair of adjacent pistons (ordinate) in the course of one full revolution of the pistons;

FIGS. 9(a) to 9(d) illustrate four successive positions of the rotors in the course of one full revolution of the engine;

FIG. 10 traces the correlation of the rotor's energy or temperature (ordinate) with the number of cycles of the engine;

FIG. 11 is a transverse section of second embodiment of the engine according to the invention;

FIG. 12 illustrates the meshing of the gears and main shaft of the engine of FIG. 11;

FIG. 13 illustrates rotors with four pistons and energy exchanges of the exhaust gases;

FIG. 14 illustrates rotors with five pistons and energy exchanges of the exhaust gases and energy produced by the cooling of the cylinder;

FIG. 15 traces changes of volume (ordinate) between a pair of adjacent pistons in a four-piston engine according to FIG. 13 with angular displacement, the full line indicating the effect of a transfer (36, below) and broken lines the case where no such transfer is employed;

FIG. 16 is a transverse section of a third engine embodying the invention and with gearing on the rotors;

FIG. 17 is a pressure (ordinate) - V(volume) graph of the apparatus of FIGS. 13 and 14;

FIG. 18 is a temperature (ordinate) and entropy diagram of the engine of FIG. 13 and 14;

FIG. 19 traces changes of temperature (ordinate) with the number of cycles of the apparatus according to FIG. 13;

FIG. 20 is an energy (ordinate) - angular displacement diagram from 0 to $2\pi$ of revolution of a classical or known engine, curve 1, and an engine according to the invention, curve 2;

FIG. 21 represents a section of a further possible rotor with circular -section piston and;

FIG. 22 represents a section at right angles to that of FIG. 21.

Referring to FIG. 1 in conjunction with FIGS. 2 to 5 and FIGS. 9(*a*) to 9(*d*) an engine according to the invention has a cylinder block 3, an intermediate casing (unreferenced), and an end casing 26. A central mainshaft 13 with a flywheel 27 carries two rotors 1, 2 each of which has three rotor vanes, referred to herein for convenience as pistons, see FIG. 2. A piston-motion control mechanism is centred on a gear 12 fixed on a cranked portion of the mainshaft 13. This mainshaft gear 12 meshes with two intermediate gears 9, 11 which in turn mesh with control gears 8, 10 on shafts 22 and 23 running in the casings.

Each rotor has a pair of associated gears of a ratio, here 3 : 1, corresponding to the number of pairs of pistons, which pairs of gears comprise rotor gears 4, 5 mounted on the rotors and rotor pinions 7, 6 mounted on the shafts 22 and 23. The intermediate gears are mounted on intermediate shafts 24, 25.

The mainshaft gear, the intermediate gears and the control gears are all of the same diameter. They are maintained at constant centers by two sets of connecting links, namely connecting links 14, 17; 19, 20 between the cranked portion of the mainshaft and the intermediate shafts, and connecting links 15, 16; 18, 21 between the intermediate shafts and the shafts 22 and 23.

When the engine is running, as described more fully later, the mainshaft runs at substantially constant speed in view of the presence of the flywheel. They speed of the rotors, however, varies under the influence of the control mechanism so that the pistons carry out three cycles of approach and retreat from each other for each revolution of the mainshaft, and the phases of a combustion cycle can therefore be carried out. The variation in speed arises because of the cranking of the mainshaft, which gives rise in the intermediate shafts to a combined motion of rotation and alternate bodily approach to and retreat from the central axis of the engine, thereby varying the resultant speed given by gear 12 to gears 9 and 11, which resultant speed is transmitted to gears 8 and 10 and hence to the rotor pinions. The variations of the rotor speeds with time is substantially sinusoidal, and the intermediate shafts are oppositely positioned so that the variations are counterphased and out-of-balance forces counteract each other.

The operation of the engine is described further below, but briefly, referring to FIGS. 9(*a*) to 9(*d*) wherein FIGS. 9(*a*), FIG. 9(*b*), FIG. 9(*c*) and FIGS. 9(*d*) respectively represent the positions of a pair of pistons at $0(2\pi)$, $\pi/2$, $\pi$ and $3\pi/2$, and considering the piston with the black spot:

1. After ignition, which has just occurred, the piston moves slowly past, under the action of the rotor speed control gearing 6 o'clock (counterclockwise rotation as seen) while expansion takes place in front of it;

2. The piston executes one third of a rotation to bring about exhaust;

3. The piston having now reached the position of the piston that was ahead of it on the same rotor in FIG. 9(*a*) moves slowly past 2 o'clock (while induction ahead of it takes place);

4. The piston executes one-third of a rotation to bring about induction of the charge behind itself and transfer the charge that is ahead of it;

5. The piston moves slowly past 10 o'clock while transfer of the charge that it induced occurs past it;

6. The piston executes one-third of a rotation to bring about compression and reach again the position shown in FIG. 9(*a*).

The cycle, as regards the given piston, then repeats. As will be clear, the same cycle is occurring as regards the other two pistons on the same rotor, so there power impulses are given for each revolution of the rotor, corresponding to one power impulse to each revolution of the mainshaft.

In operation of the engine the mainshaft 13 is subject only to linear changes of speed but when the mainshaft speed is constant the speed of shafts 22 and 23 contains oscillatory changes which under certain conditions can be traced as sinusoids with deviations of less than 1%. The speed of these shafts 22, 23 oscillates around the constant speed of the mainshaft and the oscillation period is equal to a full turn of the mainshaft with the oscillations of the two shafts being counterphased. Owing to the 1 : 3 gear ratio the rotors' speed is three times less, i.e. one full turn of the rotor corresponds to three full turns of the main shaft and to three oscillations. In the course of the piston's movement in the cylinder block they approach and move away from each other three times and while one piston is moving away it is simultaneously moving closer to the next piston of the same rotor, because the pistons of one rotor are counter-phased to those of the other rotor and vice versa. Thus the volume of the space between any two pistons will change three times in the course of one full turn around the stator, as outlined in FIG. 8, i.e. we have a series of 6 continuous cycles all around the cylinder. Four positions of the pistons are outlined in FIGS. 9(*a*) to 9(*d*), which give the starting position and the positions after one-fourth, one-half and three-fourths of the turn of the main shaft, while the full turn corresponds to the starting position with the pistons having changed their position in relation to the stator by one-third. The process of fuel combustion is taking place between the marked pistons in the starting position. In front of them is the end of the process of expansion and the beginning of exhaust and behind them the beginning of the process of compression. On opposite ends is the end of the process of induction and the beginning of the transfer of the fuel air mixture via passage 36 (FIG. 2) enclosed in the cylinder. During a period corresponding to one-quarter of a full turn of the main shaft the process of expansion is taking place in the space between the marked pistons; ahead of them is the process of exhaust, and behind the process of compression. On the opposite end the process of induction and shifting of fuel is taking place. It is important to note that the fuel air mixture is enclosed by the pistons of the same rotor during this process. Herein the increase in pressure is due to the heating of the fuel air mixture brought about by the cooling of the rotor and this increase would not be intensive enough if the pistons were made of materials whose heat conductivity was poor.

When the main shaft is at its half of a full turn point, we have the same conditions as at the starting point, but with the other rotor, and the process is proceeding as before, which means that there is one active process for every one-half turn of the main shaft, which would correspond to the process going on in a four-cylinder, four-stroke piston engine. Two passive cycles of fuel air mixture shifting have been introduced for the purpose of rotor cooling and the cooling of the pistons. The exchange of energy between the pistons and the fuel air mixture during the engine operation is represented on FIG. 10. the temperatures of the piston's outer surfaces at median levels and during the process of combustion, expansion, exhaustion and partly during the process of compression vary as they take in energy and get heated up to slightly above the median levels of temperatures and during the process of shifting the mixture these surfaces are cooling off, transferring their energy to the fuel air mixture. Since these exchanges are carried out at various levels of temperature the quantities of energy involved are not great, but its main purpose is cooling which can be enhanced with the help of good technology. If all the gaps are well defined and the technical processes well advanced, the outer surfaces of the pistons and the rotors are at fairly high levels of temperature, which will reduce the heat losses during the active part of the processes. It is assumed here that fuel injection systems would be applied. The piston's maximum levels are to be limited at the point where it would lead to self-ignition of the mixture, i.e. the maximum engine output should be limited at a lower level. The ignition is carried out with the help of a glow plug, and the ignition occurs when the glow plug is uncovered by one of the pistons.

The effects of the gases upon the pistons during the process of compression and expansion are such that the forces acting upon the gears and coming from both rotors are always the same and in balance, while the actions transmitted through the rods and the eccentric main shaft are always synchronised so that they appear at the output end of the system, if traced on a graph, in the shape of a sinusoid passing through the zero point at every one-half turn of the main shaft, which means that they appear as a positive sum of the processes of expansion and compression in the same manner as with four-cylinder, four-stroke piston engines with long piston rods.

Another suitable construction of the heat-engine has been outlined on FIG. 11 in which the rotors, instead of transmitting their actions at the same side of the engine, transmit them from opposing sides onto a two-fold main shaft 30 which is positioned outside the circle covered by the pistons. This construction gives great freedom of choice of elements of coupling. Parts are numbered as before except for the mainshaft 30 and the rotor gears 28, 29.

Rotors with 4 and 5 pistons have been outlined on FIGS. 13 and 14. The gear ratio between the rotor and the main shaft corresponds to the number of pistons and is therefore in these cases 1 : 4 and 1 : 5. The number of passive cycles is 4 and 6 respectively and they are used for the rotor cooling and the transfer of energy of exhaust gases.

In the case of the rotor having four pistons (FIG. 13) the process of the transfer of fuel air mixture is carried out through chambers 37, 36 containing heat exchangers 34, 35 through which exhaust gases are transferred. The energy taken from the exhaust gases is transferred to the fuel air mixture at a constant volume without any work being caried out. The exhaust gases are emitted from the engine at a lower temperature and at a lower pressure and with the help of an efficient heat-exchanger the exhaust gas pressure can be reduced to the level of atmospheric pressure, which means that they come out of the exchanger without any noise. Valves 31, 32, are arranged to open and close in the same sense and at the same time to change the compression ratio. Once such a ratio has been selected, susequently in normal engine operation they remain closed although they can remain open if the engine operation is subject to great variations. Valve 33 is a safety valve arranged to open if valves 31 and 32 fail.

In the case of the rotor having 5 pistons (FIG. 14) the transfer of fuel - air mixture is carried out through three chambers 38, 39, 36. The first chamber 38 is empty and while it is in operation the pistons are cooling. The second chamber 39 consists of two parts and the mixture is led from the first part of the chamber along the cylinder walls to the second part of the chamber and is used for cooling the cylinder. The mixture is then circulated through the third chamber 36, which contains the heat-exchanger 34 and in which the energy of the exhaust gases is transferred into the mixture. The maximum level of temperature achieved here is slightly less then the temperature of the exhaust gases at the point before entering the heat-exchanger. The position of the valves 31, 32 on the cylinder determines the degree of expansion and they are positioned in such a manner as to satisfy a compromise between the minimum levels of exhaust gas temperatures and space availability. The mixture which has thus been heated is then compressed only partly owing to the valve 31, but the temperature is raised considerably during the process of compression, and it might seem that this reduces the possibility of injecting large amounts of fuel. But since these levels of temperature have been achieved without any extra energy, the reduced amounts of fuel injected means in fact a saving of fuel, because the engine output is still the same. On the other hand, the reduced amounts of fuel and the high temperatures are increasing the speed of evaporation, fuel combustion is more thorough and the exhaust gases do not contain any unburnt residues, i.e. they contain only a miniumum of poisonous gases.

In this manner the invention attacks the problem of efficient fuel consumption, of the cooling of materials, and of full combustion.

As already noted in outline: FIG. 15 traces the changes in the volume of the fuel air mixture in an engine with four pistons.

FIG. 16 outlines another suitable construction of a four piston engine, in which the main shaft 30 is coupled to rotors 41, 42 which are hollow and have gear teeth on the inner side meshing with the pinions 6, 7. The casing is referenced 43.

FIGS. 17 and 18 trace the thermal cycles going on in the examples mentioned before, c.f. FIGS. 13 and 14, and FIG. 19 traces the variations of temperature with the cycles of the engine FIG. 20 is an energy-angular displacement diagram, as already stated.

The piston's horizontal sections can be circular as in FIGS. 21 and 22. If the stator and the rotors are on the heavy side the sealing can be assured by fitting piston rings as in piston engines.

I claim as my invention:

1. A rotary internal combustion engine comprising an annular cylinder; two co-axial rotors; at least three equi-spaced pistons carried by each rotor and alternately disposed in the cylinder; inlet means, exhaust means and ignition means; rotor constraining means for constraining the rotors, in use, to undergo cyclic counterphased variations in speed such that the pistons of the two rotors alternately approach and recede from each other and the expansion, exhaust, induction and compression phases of a combustion cycle can be carried out between the pistons making use of the inlet, exhaust and ignition means; means for providing at least one charge-transfer phase in the combustion cycle between induction of a charge and its compression; a transfer port disposed in said cylinder through which each charge transfer past a given piston is effected by a following piston as the given piston is moving slowly in the course of its speed variation, the number of charge transfer phases in each combustion cycle being equal to the number by which the number of pistons on each rotor exceeds two; and at least one exhaust-heat exchanger for the passage therethrough of the transferred charge, the said rotor constraining means including a mainshaft coaxial with the rotors; at least one mainshaft gear eccentrically mounted on the mainshaft; a plurality of intermediate shafts; intermediate gears mounted on the intermediate shafts and meshing with the said at least one mainshaft gear; phase-control shafts connected to be driven by the rotors; phase-control gears mounted on the phase-control shafts and meshing with the intermediate gears; the speed relation between rotors and mainshaft being $x : 1$ where $x$ is the number of pistons in each rotor, and each intermediate shaft, while free bodily to approach and recede from the axis of the mainshaft as it rotates, being maintained at a constant axial spacing from said at least one mainshaft gear on the one hand and the respective phase control shaft on the other hand.

2. A rotary, internal combustion engine including gas inlet, exhaust and ignition means and having a cylinder and two co-axial rotors each carrying at least three equi-spaced pistons disposed within and projecting towards the cylinder, rotor constraining means for constraining the rotors to undergo, during rotation thereof, cyclic counterphased and substantially sinusoidal variations in speed such that the pistons of the two rotors alternately approach and recede from one another and the expansion, exhaust, induction and compression phase of the working cycle are carried out between the pistons making use of said gas inlet, exhaust and ignition means, said engine providing at least one phase in the working cycle between induction of a charge and its compression for the transferring energy from the exhaust gases to the fuel-gas mixture at a constant volume of the latter, said engine further comprising a transfer port, disposed in said cylinder, through which said at least one phase, relative to a given piston, is effected by a following piston as the given piston is moving slowly in the course of its speed variation, means for transferring the energy from the exhaust gases to the fuel-gas mixture in said transfer port, the number of said phases in each working cycle being equal to the number by which the number of pistons on each rotor exceeds two.

3. An engine according to claim 2 further comprising a mainshaft coaxial with the rotors, at least one eccentrically mounted, common mainshaft gear carried by said mainshaft intermediate gears which mesh with said mainshaft gear, respective rotor control gears which mesh with said intermediate gears, and rotor control shafts on which said rotor control gears are mounted and which are driven by the rotors, the speed relation between rotors and mainshaft being $x : 1$ where $x$ is the number of pistons on each rotor, and each intermediate shaft, while free bodily to approach and recede from the axis of the mainshaft as it rotates, being maintained at a constant axial spacing from said at least one mainshaft gear on the one hand and the respective phase control shaft on the other hand.

4. An engine according to claim 3, further comprising a common mainshaft gear, externally toothed gears carried by the rotors, and respective pinions carried on the phase-control shaft and driven by said toothed gears, said pinions being oppositely disposed with respect to the mainshaft.

5. An engine according to claim 3, further comprising a spaced pair of mainshaft gears, externally toothed gears disposed at axially opposite ends of the cylinder and carried by the rotors, and respective pinions carried on the phase control shafts and arranged to be driven by said toothed gears.

6. An engine according to claim 3, further comprising a spaced pair of mainshaft gears, in which engine the rotors are hollow; internally toothed gears are carried by the rotors and respective pinions are adapted to be driven by said gears and are mounted on the phase control shafts which are disposed in the space within the hollow rotors.

* * * * *